US009879677B2

(12) United States Patent
Kailasam et al.

(10) Patent No.: US 9,879,677 B2
(45) Date of Patent: Jan. 30, 2018

(54) VACUUM PUMP

(71) Applicant: Edwards Limited, West Sussex (GB)

(72) Inventors: Sivabalan Kailasam, Seongnam-si (KR); Alan Ernest Kinnaird Holbrook, Pulborough (GB)

(73) Assignee: Edwards Limited, Burgess Hill, West Sussex (GB)

( * ) Notice: Subject to any disclaimer, the term of this patent is extended or adjusted under 35 U.S.C. 154(b) by 93 days.

(21) Appl. No.: 14/648,131

(22) PCT Filed: Oct. 24, 2013

(86) PCT No.: PCT/GB2013/052771
§ 371 (c)(1),
(2) Date: May 28, 2015

(87) PCT Pub. No.: WO2014/083305
PCT Pub. Date: Jun. 5, 2014

(65) Prior Publication Data

US 2015/0308430 A1 Oct. 29, 2015

(30) Foreign Application Priority Data

Nov. 30, 2012 (GB) ..... 1221599.2

(51) Int. Cl.
*F04C 27/00* (2006.01)
*F04C 23/00* (2006.01)
(Continued)

(52) U.S. Cl.
CPC ..... *F04C 27/003* (2013.01); *F01C 21/10* (2013.01); *F04C 18/123* (2013.01);
(Continued)

(58) Field of Classification Search
CPC ..... F04C 27/00–27/008; F04C 15/0003–15/0034; F04C 25/02;
(Continued)

(56) References Cited

U.S. PATENT DOCUMENTS 4,869,658 A 9/1989 Tsutsumi et al.
2002/0155014 A1* 10/2002 Durand ..... F01C 21/104 418/9

(Continued)

FOREIGN PATENT DOCUMENTS

CN 1550674 12/2004
GB 2489248 A 9/2012

(Continued)

OTHER PUBLICATIONS

State Intellectual Property Office, P.R. China, First Office Action and Search Report in corresponding Chinese patent application No. 201380062505.4 dated Mar. 17, 2016.

(Continued)

*Primary Examiner* — Mark Laurenzi
*Assistant Examiner* — Xiaoting Hu
(74) *Attorney, Agent, or Firm* — Theodore M. Magee; Westman, Champlin & Koehler, P.A.

(57) ABSTRACT

A multi-stage vacuum pump comprising: first and second half-shell stator components defining a plurality of pumping chambers and for assembly together along respective longitudinally extending faces; first and second end stator components for assembly at respective longitudinal end faces of the first and second half-shell stator components; gaskets for sealing between the first and second half-shell stator components when assembled together at the longitudinally extending faces; and O-rings for sealing between the first and second end stator components and the first and second half-shell stator components when assembled;
(Continued)

wherein annular channels intersect longitudinal recesses and each longitudinal recess comprises a stop fixed relative to the intersection, and the gasket and the longitudinal recess are configured that when the gasket is located in the recess during assembly the gasket is biased against the stop for locating an end portion of the gasket relative to the intersection.

12 Claims, 6 Drawing Sheets

(51) Int. Cl.
*F04C 25/02* (2006.01)
*F04C 18/12* (2006.01)
*F01C 21/10* (2006.01)

(52) U.S. Cl.
CPC ..... *F04C 18/126* (2013.01); *F04C 23/001* (2013.01); *F04C 25/02* (2013.01); *F04C 27/008* (2013.01); *F04C 2230/60* (2013.01); *F04C 2230/604* (2013.01)

(58) Field of Classification Search
CPC ..... F04C 2220/10; F04C 2220/12; F04C 2240/10; F04C 2240/30; F04C 23/001; F04C 11/001; F04C 2230/60; F04C 2230/601; F04C 2230/604; F04C 18/12; F04C 18/123; F04C 18/126; F01C 19/00–19/12; F01C 21/10; F01C 21/104; F04B 25/00
See application file for complete search history.

(56) References Cited

U.S. PATENT DOCUMENTS

| | | | | |
|---|---|---|---|---|
| 2010/0226808 | A1* | 9/2010 | Schofield | F04C 18/126 418/206.6 |
| 2014/0017062 | A1* | 1/2014 | Turner | F01C 19/005 415/1 |
| 2014/0286806 | A1* | 9/2014 | Holbrook | F04C 27/006 418/5 |

FOREIGN PATENT DOCUMENTS

| | | |
|---|---|---|
| JP | 2003042079 | 2/2003 |
| WO | 2009044197 A2 | 4/2009 |

OTHER PUBLICATIONS

Translation of State Intellectual Property Office, P.R. China, First Office Action and Search Report in corresponding Chinese patent application No. 201380062505.4 dated Mar. 17, 2016.

British Search Report and Examination Report dated Apr. 2, 2013 for corresponding British Application No. GB1221599.2.

PCT International Notification of Transmittal of the International Search Report and Written Opinion of the International Search Authority, or the Declaration, PCT International Search Report and PCT International Written Opinion dated Sep. 23, 2014 for corresponding PCT Application No. PCT/GB2013/052771.

* cited by examiner

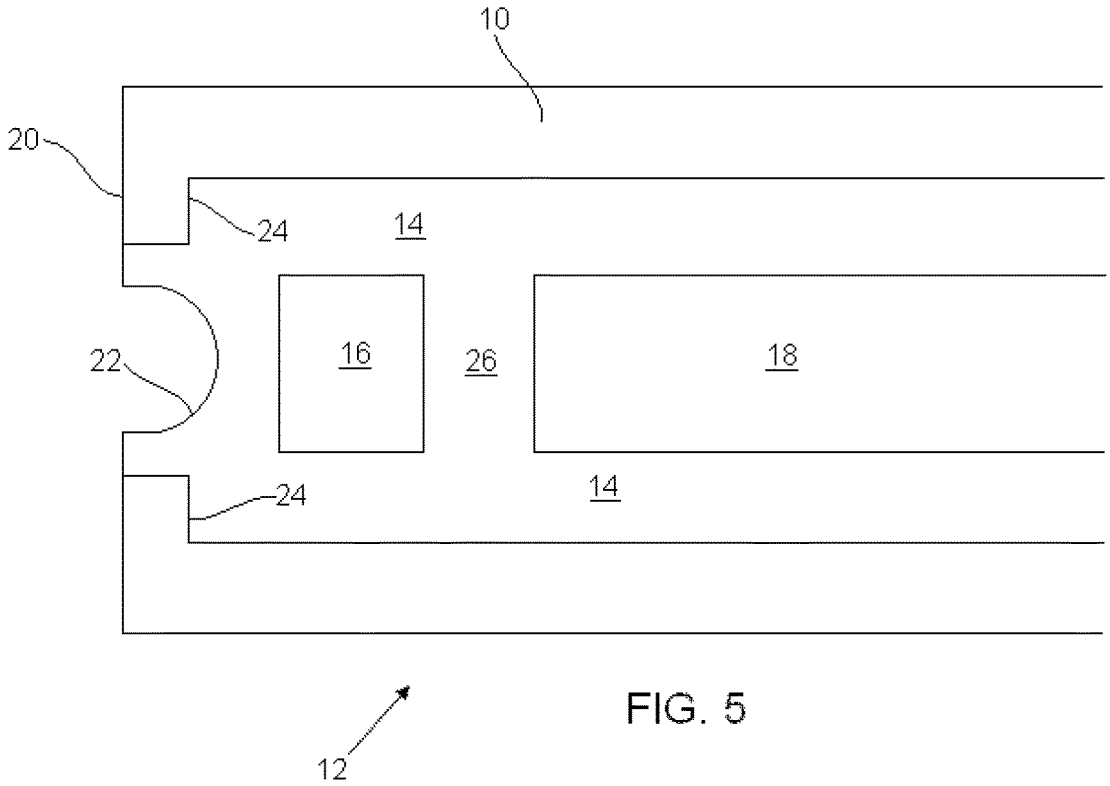
FIG. 5
FIG. 6
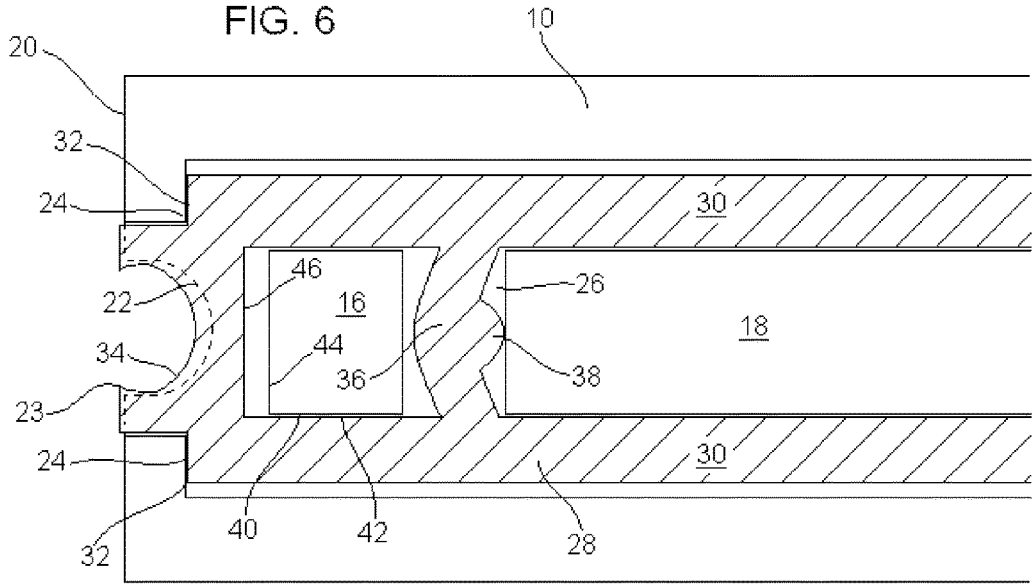

VACUUM PUMP

CROSS-REFERENCE TO RELATED APPLICATION

This application is a Section 371 National Stage Application of International Application No. PCT/GB2013/052771, filed Oct. 24, 2013, which is incorporated by reference in its entirety and published as WO 2014/083305 A2 on Jun. 5, 2014 and which claims priority of British Application No. 1221599.2, filed Nov. 30, 2012.

FIELD OF THE INVENTION

The invention relates to a vacuum pump, in particular a multi-stage vacuum pump and a stator of such a pump.

BACKGROUND

A vacuum pump may be formed by positive displacement pumps such as roots or claw pumps, having one or more pumping stages connected in series. Multi-stage pumps are desirable because they involve less manufacturing cost and assembly time compared to multiple single stage pumps in series.

Multi-stage roots or claw pumps may be manufactured and assembled in the form of a clamshell. As shown in FIG. 1, the stator 100 of such a pump comprises first and second half-shell stator components 102, 104 which together define a plurality of pumping chambers 106, 108, 110, 112, 114, 116. Each of the half-shells has first and second longitudinally extending faces which mutually engage with the respective longitudinally extending faces of the other half-shell when the half-shells are fitted together. Only the two longitudinally extending faces 118, 120 of half-shell 102 are visible in the Figure. During assembly the two half shells are brought together in a generally radial direction shown by the arrows R.

The stator 100 further comprises first and second end stator components 122, 124. When the half-shells have been fitted together, the first and second end components are fitted to respective end faces 126, 128 of the joined half-shells in a generally axial, or longitudinal, direction shown by arrows L. The inner faces 130, 132 of the end components mutually engage with respective end faces 126, 128 of the half-shells.

Each of the pumping chambers 106-116 is formed between transverse walls 134 of the half-shells. Only the transverse walls of half-shell 102 can be seen in FIG. 1. When the half-shells are assembled the transverse walls provide axial separation between one pumping chamber and an adjacent pumping chamber, or between the end pumping chambers 106, 116 and the end stator components. The present example shows a typical stator arrangement for a roots or claw pump having two longitudinally extending shafts (not shown) which are located in the apertures 136 formed in the transverse walls 134 when the half-shells are fitted together. Prior to assembly, rotors (not shown) are fitted to the shafts so that two rotors are located in each pumping chamber. Although not shown in this simplified drawing, the end components each have two apertures through which the shafts extend. The shafts are supported by bearings in the end components and driven by a motor and gear mechanism.

The multi-stage vacuum pump operates at pressures within the pumping chamber less than atmosphere and potentially as low as $10^{-3}$ mbar. Accordingly, there will be a pressure differential between atmosphere and the inside of the pump. Leakage of surrounding gas into the pump must therefore be prevented at the joints between the stator components, which are formed between the longitudinally extending surfaces 118, 120 of the half-shells and between the end faces 126, 128 of the half-shells and the inner faces 130, 132 of the end components. An adhesive is typically used to seal between the half-shells and between the half-shells and the end components, but the adhesive is particularly susceptible to damage by corrosive pumped gases, and is difficult and time consuming to apply consistently. It can also inhibit disassembly and maintenance.

A known alternative sealing arrangement is disclosed in US2002155014 providing a one piece sealing member comprising two longitudinal portions and two annular portions. The sealing member is however generally quite intricate to fit in place and expensive to manufacture.

The discussion above is merely provided for general background information and is not intended to be used as an aid in determining the scope of the claimed subject matter. The claimed subject matter is not limited to implementations that solve any or all disadvantages noted in the background.

SUMMARY

The present invention provides an improved seal arrangement for sealing a clam shell pump.

The present invention provides a multi-stage vacuum pump comprising: first and second half-shell stator components defining a plurality of pumping chambers for assembly together along respective longitudinal faces; first and second end stator components for assembly at respective end faces of the first and second half-shell stator components; gaskets for location in a longitudinal recess of respective longitudinal faces for sealing between the first and second half-shell stator components when assembled together; and O-rings for location in annular channels counter-sunk in respective end faces for sealing between the first and second end stator components and the first and second half-shell stator components when assembled; wherein the annular channels intersect the longitudinal recesses and each longitudinal recess comprises a stop fixed relative to the intersection, and the gasket and the longitudinal recess are configured that when the gasket is located in the recess during assembly the gasket is biased against the stop for locating an end portion of the gasket relative to the intersection.

The present invention also provides apparatus for assembling a multi-stage vacuum pump comprising a tool and the parts of such a multi-stage vacuum pump, wherein the tool is arranged for aligning the shaped end portions of the gaskets with the correspondingly shaped intersections between the annular channels and the longitudinal recesses when the gaskets have been fitted in the longitudinal recesses and prior to compression of the gasket between the half-shell stator portions.

The present invention also provides a method of assembling a multi-stage vacuum pump, the vacuum pump comprising: first and second half-shell stator components defining a plurality of pumping chambers for assembly together along respective longitudinal faces; first and second end stator components for assembly at respective end faces of the first and second half-shell stator components; gaskets for location in a longitudinal recess of respective longitudinal faces for sealing between the first and second half-shell stator components when assembled together; and O-rings for location in annular channels counter-sunk in respective end faces for sealing between the first and second end stator components and the first and second half-shell stator components when assembled, the annular channels intersecting the longitudinal recesses at respective intersections, wherein the method comprises: fitting each gasket in a said longitudinal recess; biasing the gasket against a stop fixed relative to the intersection for locating an end portion of the gasket relative to the intersection such that the end portion sits proud of the intersection; pressing the end portion of the gasket with a tool generally to align the end portion with the intersection during compression of the gasket as the half-shell components are assembled together along the longitudinal faces; fitting the O-rings in the annular channels; assembling the end stator components to the half-shell stator components.

Other preferred and/or optional features of the invention are defined in the accompanying claims.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

In order that the present invention may be well understood, an embodiment thereof, which is given by way of example only, will now be described in more detail, with reference to the accompanying drawings, in which:

FIG. 5 shows a part of one half-shell stator component according to an embodiment of the invention;

FIG. 6 shows arrangement gasket fitted in the half-shell component shown in FIG. 5;

DETAIL DESCRIPTION

By way of background to the invention, US2002155014 discusses the problem of sealing a clam shell stator. In particular, it indicates that leakage lines exist between a longitudinal gasket providing peripheral radial sealing and O-rings providing axial sealing at the ends which results in unsatisfactory sealing. As a consequence the patent proposes a one-piece sealing member as discussed above.

Figure 1:
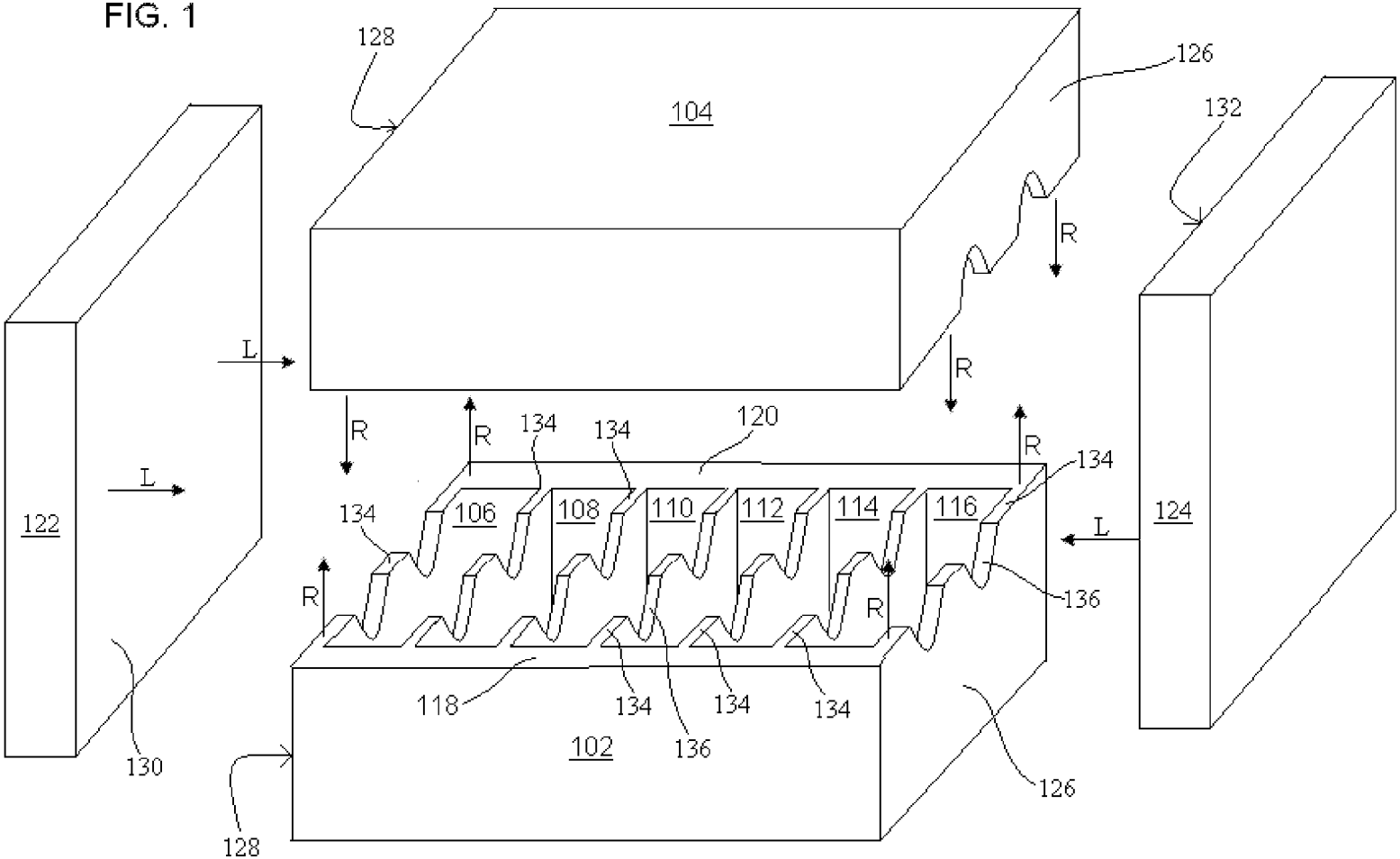
FIG. 1 shows generally the components of a clam shell stator.
Figure 2:
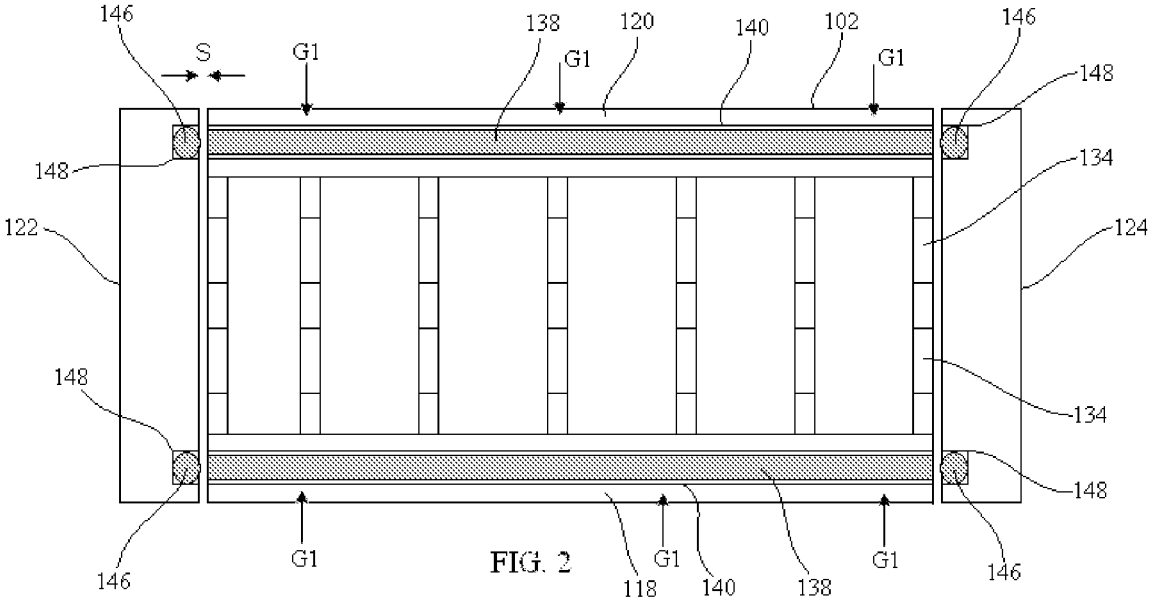
FIG. 2 shows a theoretically possible but undesirable sealing arrangement for the half-shell stator components and two stator end components provided for explanatory purposes only.
Figure 3:
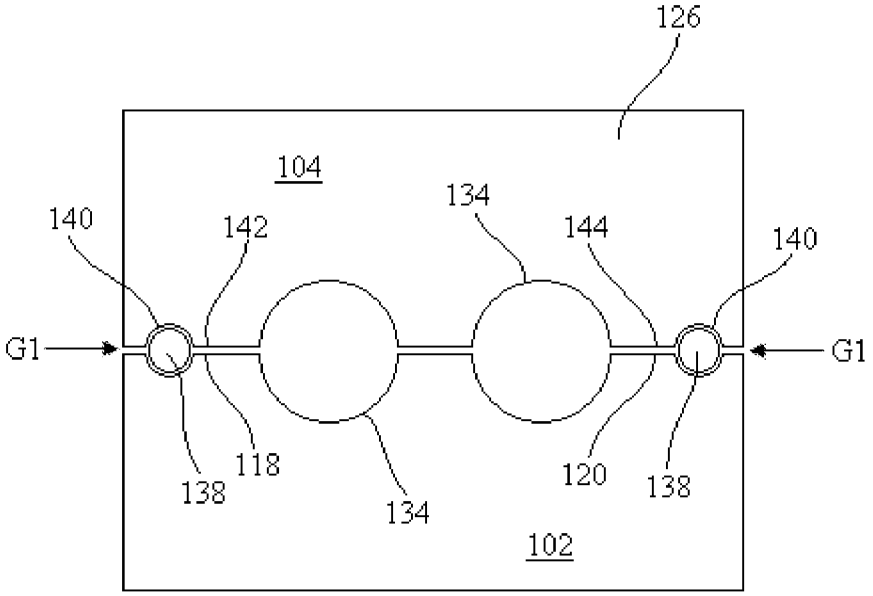
FIG. 3 shows a half-shell having the sealing arrangement of FIG. 2.
Figure 4:
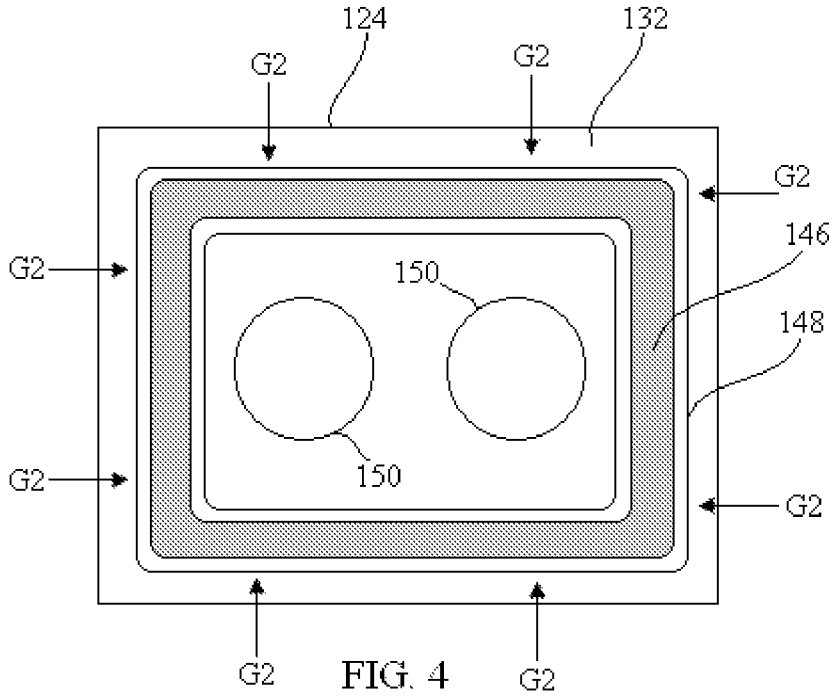
FIG. 4 shows an end component having the sealing arrangement of FIG. 2.

Looking in more detail now at this problem, FIG. 2 shows a plan view of the half-shell 102 and sections taken through end components 122, 124. FIG. 3 shows a view of one end face 126 of the joined half-shells 102, 104. FIG. 4 shows a view of an inner face 132 of an end component 124.

Referring to FIGS. 2 to 4, two longitudinal seal members 138 are located in channels 140 formed in the longitudinally extending faces 118, 120 and 142, 144 of the first and second half-shells 102, 104. The longitudinal seal members 138 resist leakage of ambient gases into the pump as shown by the arrows G1 over the length of the half-shells.

Two generally annular seal members 146 are located in respective generally annular channels 148 of the inner faces 130, 132 of the end components 122, 124. The seal members 146 resist leakage of ambient gases into the pump as shown by the arrows G2 over the periphery of the joint between the end components and the half-shells. Accordingly, the leakage of gases through the apertures 150 in the end components or the apertures 134 in the end of the joined half-shells is generally prevented.

A problem with this sealing arrangement is that an inconsistent seal is provided between the longitudinal seal members 138 and the annular seal members 146 as indicated by a space S shown in FIG. 2. The inconsistent seal allows leakage of gases between the two seal members 138, 146. The longitudinal seal members 138 are configured to be compressed between the two half-shells when they are assembled together to provide a tight fit. However, when compressed there is a tendency for some movement of the seal members 138 in the channels 140 whereby the space S may be created or increased. The longitudinal seal members can be manufactured with a longer length than the length of the channels 140, however, in this case compression between the half-shells may lead to kinking in the seal members causing leakage.

FIGS. 5 to 10 show an embodiment of the invention illustrating an end of a longitudinal face of one half-shell stator component. The half-shells are generally similar to the clam-shell pump discussed in detail in relation to FIGS. 1 to 4, except that the sealing arrangement is different. The embodiment comprises a multi-stage vacuum pump comprising first and second half-shell stator components defining a plurality of pumping chambers for assembly together along respective longitudinal faces. First and second end stator components are arranged for assembly at respective end faces of the first and second half-shell stator components. Gaskets are arranged for location in a longitudinal recess of respective longitudinal faces for sealing between the first and second half-shell stator components when assembled together and O-rings are located in annular channels counter-sunk in respective end faces for sealing between the first and second end stator components and the first and second half-shell stator components when assembled. In the arrangement, the annular channels intersect the longitudinal recesses.

In more detail, FIG. 5 shows an end of one longitudinal face 10 of a half-shell 12. The other end of the longitudinal face may have a similar configuration and the ends of other longitudinal faces may have similar configurations.

The longitudinally face 10 has countersunk into its surface a longitudinal recess, or channel, 14 for locating a gasket (shown in FIGS. 6 to 10). Upstanding generally orthogonally from the recess are two walls 16, 18 having upper surfaces which are flush with the face 10. In another arrangement the wall may extend into the recess of the opposing half-shell if the opposing face comprises a recess. The end face 20 of the half-shell has countersunk therein a generally annular channel 22 for receiving an annular seal member (shown in FIG. 10). Only a cross-section of the annular channel 22 is shown in FIGS. 5 to 10 at the intersection with the longitudinal recess 14 at which the channel is extending generally perpendicular to the recess 14. The annular channel 22 is formed in the recess 14 at the intersection and has a generally semi-circular cross-section.

The longitudinal recess comprises upstanding end portions 24 for forming a stop to constrain movement of a gasket in a longitudinal dimension as described below. A cross-channel 26 extends between the upstanding walls 16, 18 and is arranged to allow a biasing force to be generated for urging the gasket against the stop, again as described below.

Referring to FIG. 6, the gasket 28 is shown shaded to aid differentiation from the face 10. The gasket is generally similar in shape to the recess 14 and has a thickness which causes its upper face to sit proud of the face 10 when fitted in the recess, for example by about a few fractions of a millimeter (e.g. 0.2 mm), for compression by an opposing longitudinal face of the second half-shell during assembly. The gasket comprises two generally parallel longitudinal portions 30 for sealing along the length of the face 10 when the pump is assembled. The longitudinal portions 30 terminate in shoulders 32 for abutting against the end portions 24 of the recess 14. An end portion of the gasket comprises a generally semi-circular sealing surface 34 which is shaped to correspond with the intersection 22 (shown in broken lines) between the annular groove and the recess 14 for sealing between the gasket and the O-ring when the O-ring is received in the channel. As shown, the sealing surface extends through more than 180 degrees and terminates at points 23.

The gasket 28 and the longitudinal recess 14 are configured that when the gasket is located in the recess during assembly the gasket is biased against the stop 24 for locating the end portion of the gasket and sealing surface 34 relative to the intersection. In this example, the gasket 18 comprises a biasing member 36 which when inserted into the longitudinal recess 14 acts against the upstanding wall 18 to bias the shoulders 32 of the gasket against the stops 24. The biasing member comprises a laterally extending cross-member received in cross-channel 26 having a protrusion 38 for bearing against the upstanding wall and which causes elastic deformation of the cross-member when the gasket is inserted in the longitudinal recess. The protrusion in the illustrated example comprises a bulbous portion of the cross-member which causes the required deformation.

The biasing force of the cross-member 36 causes the gasket to butt against the stops which constrain movement of the gasket in a longitudinal dimension. The fixed relative positioning between the stops and the intersection 22 means that the sealing surface 34 of the gasket is reliably located relative to the intersection. As illustrated, the end portion extends to a small extent proud of the end face 20 and the intersection 22.

The upstanding end portions 24 of the longitudinal recess are proximate the intersection which is preferable for locating the end portion of the gasket relative to the intersection. In an alternative the stops may comprise a second upstanding wall of the longitudinal recess against which a second cross-member of the gasket is biased for locating the end portion of the gasket relative to the intersection.

The upstanding walls 16, 18 also serve to locate the gasket in the lateral dimension when fitted in the recess. In this regard, longitudinally extending surfaces 40 of the upstanding walls engage longitudinally extending surfaces 42 of the gasket. The upstanding wall 16 comprises a laterally extending surface 44 which is spaced away from the laterally extending surface 46 of the gasket during this stage of assembly. When the gasket is compressed by assembling the half-shells together the gasket extends laterally into the space between surfaces 44, 46 but leaves sufficient space to allow for thermal expansion during use of the pump.

Figure 7:
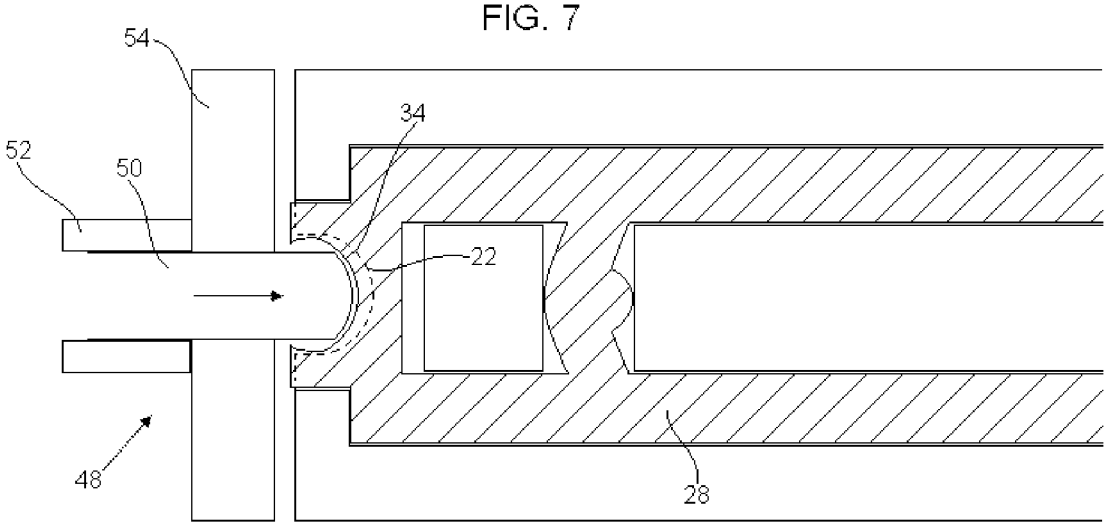
FIG. 7 shows additionally a tool for aligning the gasket prior to alignment.
Figure 8:
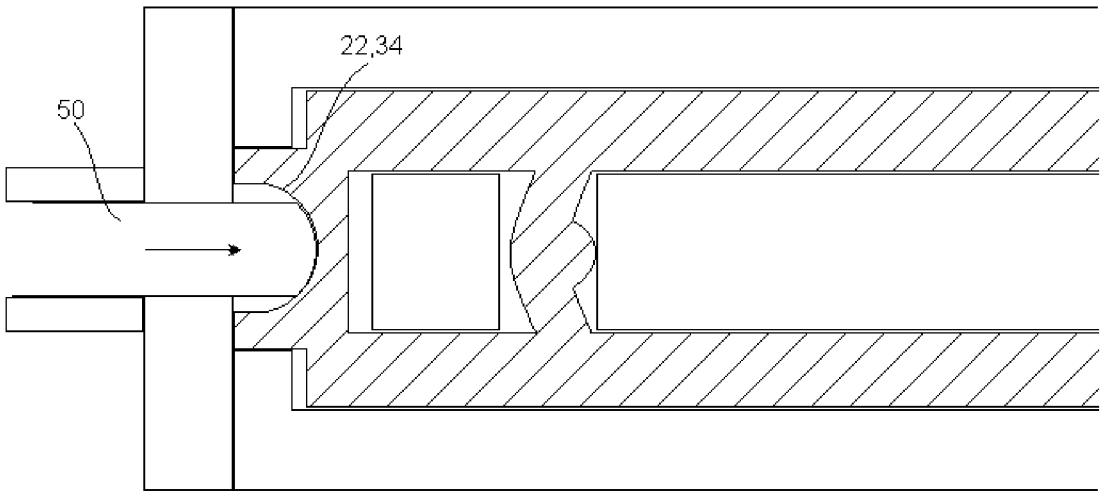
FIG. 8 shows the arrangement subsequent to alignment.

When the gasket 28 has been fitted in the recess 14, the sealing surface 34 is aligned with the intersection by a tool 48, as shown in FIG. 7 in an unaligned condition and FIG. 8 in an aligned condition. The tool comprises a spring loaded member 50 biased by a spring 52 for causing compression of the end portion of the gasket in the longitudinal dimension as shown by the arrow in the Figures. The spring loaded member 50 has a rounded end to correspond with the shape of the sealing surface and intersection. The spring 52 and member 50 are supported by a jig 54 which is fixed relative to the stator half-shell.

Figure 9:
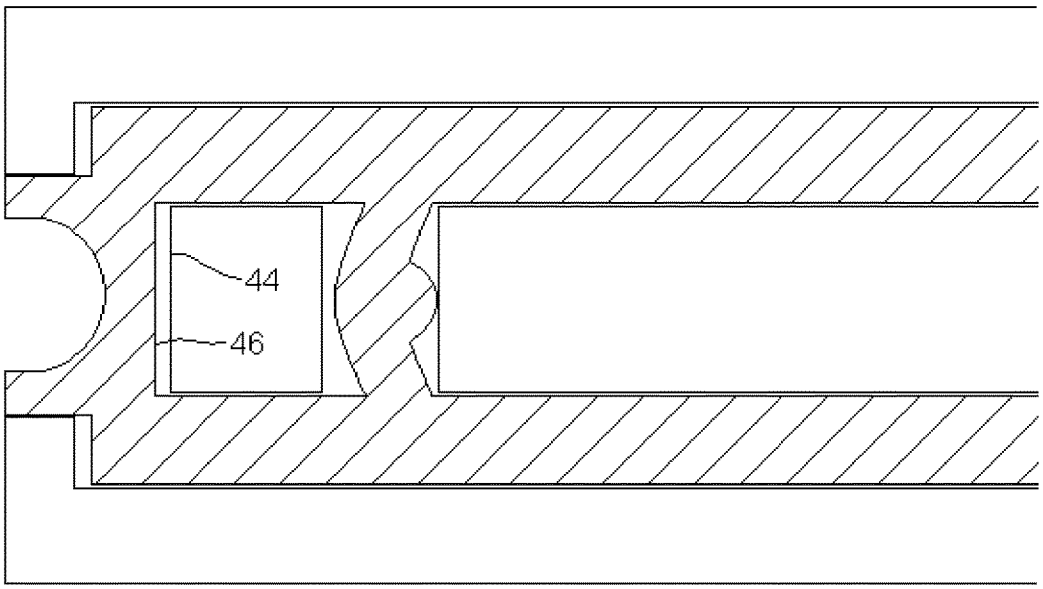
FIG. 9 shows the fitted gasket after compression between half-shells and removal of the tool.
Figure 10:
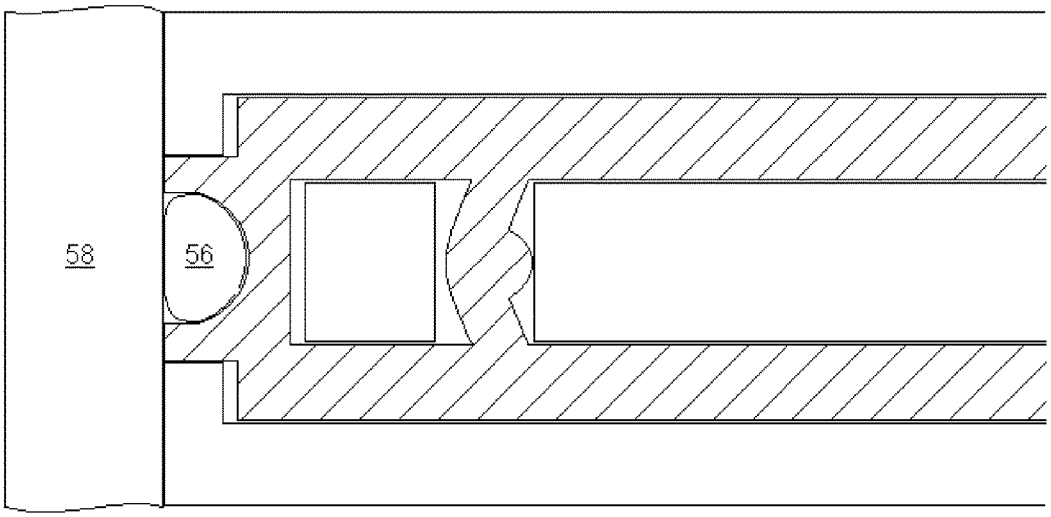
FIG. 10 shows additionally an O-ring and end plate fitted to the half-shell components.

When the end portion of the gasket has been aligned with the stator intersection the tool is maintained in position during assembly of the opposing half-shell with the illustrated half-shell. When assembled the gasket is compressed and undergoes expansion however the tool 48 maintains the sealing surface 34 in alignment with the intersection 22. Once the half-shells have been fastened together the tool is removed. The compression between the half-shells maintains the gasket is position and preserves the alignment, as shown in FIG. 9 with the tool removed. During the compression, the gasket undergoes longitudinal expansion into the space between laterally extending surfaces 44, 46.

In a next stage of assembly, the O-ring 56 is located in the annular channel and a head plate 58 secured in position. It will be seen that the O-ring deforms when compressed between end faces to take up the shape of the sealing surface 34 and the intersection thereby creating an extended sealing surface through substantially 180 degrees for resisting the leakage of ambient gas into the pump.

Therefore, the present embodiment provides a method of assembling a multi-stage vacuum pump, comprising fitting a gasket 28 in a longitudinal recess 14 as shown in FIG. 6. The subsequent stage involves biasing the gasket against a stop fixed relative to the intersection for locating an end portion of the gasket relative to the intersection such that the end portion sits proud of the intersection. The next method step comprises pressing the end portion of the gasket with a tool generally to align the end portion with the intersection during compression of the gasket as the half-shell components are assembled together along the longitudinal faces, as shown in FIGS. 7 and 8. The following steps involve fitting the O-rings 56 in the annular channels 22 and assembling the end stator components 58 to the half-shell stator components.

The gaskets may be formed from a relatively hard material such as a metal or hard elastomer. In this case, it is important to control the sealing force between the gasket and the annular seal member so that the gasket does not damage the annular seal member when they are compressed together.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A multi-stage vacuum pump comprising:

first and second half-shell stator components defining a plurality of pumping chambers for assembly together along respective longitudinal faces;

first and second end stator components for assembly at respective end faces of the first and second half-shell stator components;

gaskets for location in longitudinal recesses of the respective longitudinal faces for sealing between the first and second half-shell stator components when assembled together; and O-rings for location in annular channels counter-sunk in the respective end faces for sealing between the first and second end stator components and the first and second half-shell stator components when assembled;

wherein the annular channels intersect the longitudinal recesses at respective intersections and each longitudinal recess comprises a stop fixed relative to the intersection, and the gasket and the longitudinal recess are configured such that when the gasket is located in the recess and not under compression during assembly the gasket is biased towards the intersection against the stop for locating an end portion of the gasket relative to said intersection.

2. The multi-stage vacuum pump of claim 1, wherein the end portion of each gasket is shaped to correspond with the intersection for sealing between the gasket and the O-ring when the O-ring is received in the channel.

3. The multi-stage vacuum pump of claim 1, wherein the longitudinal recess comprises an upstanding wall and each gasket comprises a biasing member which when inserted into the longitudinal recess acts against the upstanding wall to bias the gasket against the stop.

4. The multi-stage vacuum pump of claim 3, wherein the biasing member comprises a laterally extending cross-member having a protrusion for bearing against the upstanding wall and which causes elastic deformation of the cross-member when the gasket is inserted in the longitudinal recess.

5. The multi-stage vacuum pump of claim 4, wherein the stop comprises an upstanding end portion of the longitudinal recess proximate the intersection against which a shoulder of the gasket is biased for locating the end portion of the gasket relative to the intersection.

6. The multi-stage vacuum of claim 4, wherein the stop comprises a second upstanding wall of the longitudinal recess against which a second cross-member of the gasket is biased for locating the end portion of the gasket relative to the intersection.

7. The multi-stage vacuum pump of claim 1, wherein the stop is arranged to constrain movement of the gasket in a longitudinal dimension.

8. The multi-stage vacuum pump of claim 1, wherein the longitudinal recess comprises a longitudinally extending upstanding wall for constraining lateral movement of the end portion of the gasket relative to the intersection When the gasket is fitted in the longitudinal recess.

9. The multi-stage vacuum pump of claim 1, wherein a tool is arranged for aligning the end portions of the gaskets with the intersections between the annular channels and the longitudinal recesses when the gaskets have been fitted in the respective longitudinal recesses and prior to compression of the gasket between the half-shell stator components, the end portions of the gaskets and the intersections being correspondingly shaped.

10. The multi-stage vacuum of claim 9, wherein the tool comprises a tool biasing member configured to be received in the intersection for biasing the shaped end portion of the gasket into alignment with the intersection.

11. The multi-stage vacuum pump of claim 10, wherein the tool biasing member has a rounded end shaped to complement the corresponding shape of the intersection and the end portion of the gasket.

12. A method of assembling a multi-stage vacuum pump, the vacuum pump comprising:

first and second half-shell stator components defining a plurality of pumping chambers for assembly together along respective longitudinal faces;

first and second end stator components for assembly at respective end faces of the first and second half-shell stator components;

gaskets for location in longitudinal recesses of the respective longitudinal faces for sealing between the first and second half-shell stator components when assembled together; and O-rings for location in annular channels counter-sunk in the respective end faces for sealing between the first and second end stator components and the first and second half-shell stator components when assembled, the annular channels intersecting the longitudinal recesses at respective intersections, wherein the method comprises:

fitting each gasket in respective said longitudinal recesses;

biasing the gasket towards the intersection against a stop fixed relative to the intersection for locating an end portion of the gasket relative to the intersection such that the end portion sits proud of the intersection;

pressing the end portion of the gasket with a tool generally to align the end portion with the intersection during compression of the gasket as the first and second half-shell stator components are assembled together along the longitudinal faces;

fitting the O-rings in the annular channels;

assembling the first and second end stator components to the first and second half-shell stator components.

* * * * *